US009186681B2

(12) United States Patent
Cohen

(10) Patent No.: US 9,186,681 B2
(45) Date of Patent: Nov. 17, 2015

(54) APPARATUS FOR SIZING AND SEPARATING PARTICULATE MATERIAL

(71) Applicant: Screen Machine Industries, Inc., Pataskala, OH (US)

(72) Inventor: Douglas J. Cohen, Bexley, OH (US)

(73) Assignee: SCREEN MACHINE INDUSTRIES LLC, Pataskala, OH (US)

( * ) Notice: Subject to any disclaimer, the term of this patent is extended or adjusted under 35 U.S.C. 154(b) by 335 days.

(21) Appl. No.: 13/710,080

(22) Filed: Dec. 10, 2012

(65) Prior Publication Data

US 2014/0158798 A1 Jun. 12, 2014

(51) Int. Cl.

| | |
|---|---|
| ***B02C 23/08*** | (2006.01) |
| ***B02C 21/02*** | (2006.01) |
| ***B02C 23/02*** | (2006.01) |

(52) U.S. Cl.

CPC ..... *B02C 21/026* (2013.01); *B02C 23/02* (2013.01); *B02C 23/08* (2013.01)

(58) Field of Classification Search

CPC .... B02C 23/16; B02C 13/284; B02C 18/144; B02C 21/02; B02C 13/286; B02C 17/002; B02C 2/04; B02C 18/225; B02C 23/02; B02C 21/026; B02C 23/08

USPC ..... 241/73, 81, 186.35, 223, 230, 285.1, 241/285.2, 285.3, 286

See application file for complete search history.

(56) References Cited

U.S. PATENT DOCUMENTS

| | | | | |
|---|---|---|---|---|
| 1,476,880 | A | | 12/1923 | Earle |
| 3,016,203 | A | | 1/1962 | Sears et al. |
| 3,117,734 | A | | 1/1964 | McCarty |
| 3,125,303 | A | | 3/1964 | McCarty |
| 3,203,632 | A | | 8/1965 | Poynter |
| 4,598,875 | A | | 7/1986 | Bronson et al. |
| 4,655,402 | A | | 4/1987 | Desourdy |
| 5,181,663 | A | * | 1/1993 | Dorscht et al. ..... 241/81 |
| 5,333,725 | A | | 8/1994 | Douglas |
| 5,335,784 | A | * | 8/1994 | Tyler ..... 209/260 |
| 5,445,330 | A | * | 8/1995 | Shokry Rashwan et al. ... 241/78 |

(Continued)

OTHER PUBLICATIONS

Terex Finlay, Finlay Machine, Model C-1540 Cone Crusher; downloaded from www.terexfinlay.com, Jul. 22, 2014, two pages.

(Continued)

*Primary Examiner* — Faye Francis
*Assistant Examiner* — Onekki Jolly
(74) *Attorney, Agent, or Firm* — Jason A. Bernstein; Barnes & Thornburg LLP

(57) ABSTRACT

An apparatus for separating and sizing particulate matter, comprising a main frame, infeed conveyor, collection conveyor and a screening assembly including a frame, screen, and an underscreen conveyor mounted underneath the screen. In exemplary embodiments at least one crusher is included. The apparatus converts configuration from a transport mode to an operating mode. Material deposited onto the infeed conveyor is moved forward into the screening assembly. Material falling through the screen is deflected by a deflector onto a collection conveyor. Material passing over the screen drops into the crusher and crushed material drops onto the collection conveyor. Material on the collection conveyor is conveyed to a discharge location. The apparatus components are arranged such that material moves in a uni-directional flow through the apparatus without reversing direction. The apparatus may be mounted on a mobilizing assembly, such as one including endless tracks or wheels, for portability.

24 Claims, 15 Drawing Sheets

(56) References Cited

U.S. PATENT DOCUMENTS

| | | | | |
|---|---|---|---|---|
| 5,460,332 | A | 10/1995 | Frick | |
| 5,655,719 | A * | 8/1997 | Getz | 241/27 |
| 6,186,338 | B1 | 2/2001 | Douglas | |
| 6,626,608 | B2 | 9/2003 | Olynyk | |
| 6,698,594 | B2 | 3/2004 | Cohen et al. | |
| 6,752,339 | B2 | 6/2004 | Moriya et al. | |
| 7,004,411 | B2 | 2/2006 | Nuora et al. | |
| 7,121,487 | B2 * | 10/2006 | Cohen et al. | 241/79.3 |
| 7,971,726 | B2 | 7/2011 | Lewis | |
| 2003/0173265 | A1 * | 9/2003 | Cohen et al. | 209/241 |
| 2010/0193619 | A1 | 8/2010 | Robinson et al. | |

OTHER PUBLICATIONS

Terex Finlay; Finlay Machine, Model C-1550 Cone Crusher; screen shot www.terexfinlay.com, Jul. 22, 2014, one page.
Telsmith Gyrasphereso®; Model 52S Gyrasphere with a 6×20 Specmaker screen, (2006), p. 11.
Telsmith, Inc.; 44CCP Closed Circuit Cone Plant; downloaded from www.telsmith.com; Mar. 2005, four pages.
Wirtgen-Kleemann; Mobirex Track Mounted Impact Crushers brochure, downloaded from website Jul. 22, 2014, 20 pages.
McCloskey International; Specifications McCloskey C44 Brochure; Sep. 2008, issue 002, six pages.
Construction Equipment Company; CEC Roadrunner SC 300, downloaded from www.ceccrushers.com/productdetail.aspx?id=93, Jul. 22, 2014, one page.
Construction Equipment Company; CEC SC 300 Super Cone Series Brochure; downloaded from www.ceccrushers.com/productdetail.aspx?id=93, 2006(?), ten pages.
Shanghai Shibang Machinery Company; Mobile Cone Crusher, downloaded from http://crushers.crushersolution.com/crusher-application/mobile-cone-crusher.html, Mar. 26, 2013, three pages.
Zhengzhou; Screen Cone Crusher, downloaded from www.asmaccrusher.com/Mobile_Crushers/tire-mobile-crusher-plant.html, May 24, 2012, one page.
Zhengzhou Unique Industrial Equip.Co.; Cone Crusher, downloaded from www.unique-machinery.com, May 24, 2012, one page.
Telsmith; Cone Crusher drawing, downloaded from www.telesmith.com/Product%, Nov. 12, 2003, one page.
Telsmith; SBS Cone Crushers, downloaded from www.telsmith.com, Mar. 2005, sixteen pages.
DSMAC Crushers Group; Mobile Cone Crusher, downloaded from www.dsmaccrusher.com/Mobile_Crushers/mobile-cone-crusher.html, Mar. 28, 2013, two pages.
Extec Eastern; A Full Range of Screening, Crushing, Conveying and Processing Equipment—New Crushing Products, downloaded from www.exteceastern.com/new_extec.html, four pages.
Keestrack Equipment; Destroyer 1312, downloaded from www.keestrack.com/en/US/obecne-products/mobile-crushing/crusher-1312/technical-specification, Mar. 28, 2013, one page.
CEC; Cone Crushers 400 Series Road Runner Closed Circuit Cone plant; downloaded from website www.ceccrushers.com, Apr. 26, 2004; one page.
Kleemann; Mobirex; downloaded from website www.kleemann-reiner.de; Apr. 14, 2005.
Mobile Cone Crusher; Shanghai Shibang Machinery Co., Ltd.; Sep. 10, 2010; downloaded from http://www.mineralcrusher.com/mobile-cone-crusher.html.
Cone Crusher and Vibrating Screen Combination Mobile Crushing Plant; Liming Heavy Industry; Jan. 18, 2012; downloaded from http://www.coal-crusher.net/Crusher-Mill/Perfect-Combination-Type/Cone-crusher-Vibrating-screen-combination-mobile-crushing-plant.html.
Model GCS 14.10; Heavy-Duty Mobile Crushing Unit with Impact Crusher; May 7, 2012; downloaded from http://www.rev.it/en_gcs1410.php.
Model GCS 140; Crushing Unit with Apron Feeder, Roller Scalper, and Jaw Crusher; May 7, 2012; downloaded from http://www.rev.it/en_gcs140.php.
Model Rev GSC 107; Mobile Crushing Unit ; 2000; downloaded from http://www.machineryzone.com/used/crusher/4367416/rev-gsc-107.html.
Model Rev GCS90; Mobile Crushing Unit ; 2000; downloaded from http://www.machineryzone.com/used/crusher/3210097/rev-gcs90.html.

* cited by examiner

APPARATUS FOR SIZING AND SEPARATING PARTICULATE MATERIAL

FIELD

The present disclosure relates, in exemplary embodiments, to apparatus for separating and, optionally, crushing, particulate material of various sizes.

BACKGROUND

Material that is the result of mining, grading, construction or the like is composed of large rocks, tree roots, branches, smaller rocks or stones, gravel, dirt and the like. Separating large quantities of such material at the site where the material is produced is needed so that different fractions of the material can be transported and used for different purposes. The use of the material is based on the average particle size. Therefore, apparatus for continuous separation of large amounts of mixed size material are known. Often, these apparatus also crush larger size matter, such as rocks, down to an average size that can be used in various ways.

Some types of separating apparatus are often transported from site to site, such as by being loaded onto a carrier that can be transported on roadways, if the overall height of the apparatus and the carrier is short enough to travel through tunnels, bridges, etc. At a production site, mobile separating apparatus can move from location to location within the site under their own power if they are mounted on wheels or tracks. Accordingly, the design of the apparatus must balance the separating needs as well as the size and transportability needs.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

Generally described, the present disclosure provides in exemplary embodiments an apparatus for separating and sizing particulate material, such material typically composed of matter of different types and having several different average sizes, the apparatus including a main frame, an engine, an infeed conveyor, a collection conveyor, a screening assembly and, in various exemplary embodiments, a crusher. The screening assembly may be generally composed of a frame, at least one screen, and an underscreen conveyor mounted to the frame and generally underneath the screen. The crusher may be a cone crusher or other type of crushing unit. The apparatus components are arranged such that the engine is mounted generally underneath the screening assembly and the discharge end of the screen is positioned above the crusher. Unseparated or pre-separated material is deposited onto the infeed conveyor which transports material to the screening assembly. Material that falls through the screen is conveyed by the underscreen conveyor and discharged onto the collection conveyor. Material not passing through the screen is directed toward the opening of the crusher. Crushed material exiting the crusher falls onto the collection conveyor receiving section. The collection conveyor is associated with the main frame such that a collection conveyor receiving section is positioned below the underscreen conveyor discharge end so that material being discharged from the underscreen conveyor falls and is delivered to the collection conveyor. A deflector can aid in directing the flow of falling material onto the collection conveyor. The combination of screened material and crushed material are discharged by the collection conveyor to discharge pile.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which.

DETAILED DESCRIPTION

Figure 1:
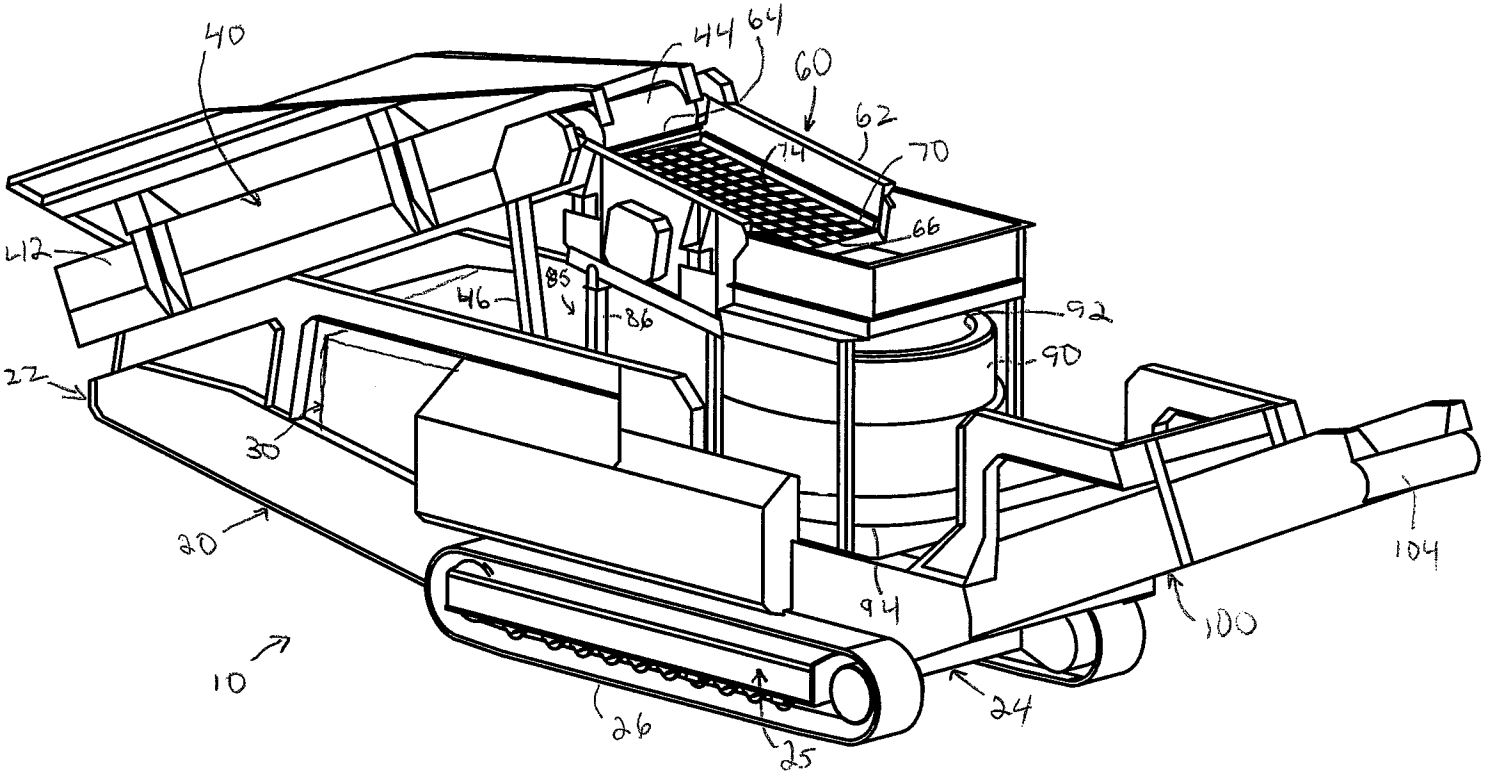
FIG. 1 is a perspective view of a first exemplary embodiment of an apparatus of the present disclosure configured in an operating mode.

FIGS. 1-5 show several views of one exemplary embodiment of an apparatus 10 for separating material 12 that includes a main frame 20 having two ends generally referred to as an infeed end section 22 and a discharge end section 24. The main frame 20 is a generally rigid elongated structure and has a longitudinal axis shown in FIG. 2 as dashed line. "LA", whereby positioning of components or movement of particulate material 12 along the longitudinal axis LA is referred to as being in an in-line position or in-line movement, respectively. Positioning of components or movement of particulate material in a direction transverse to the longitudinal axis LA is referred to as "lateral" position or movement, respectively, and is meant to include 90 degree as well as acute or obtuse angles with respect to the longitudinal axis LA. Similarly, "in-line" is intended to include position or movement that is generally parallel to the longitudinal axis LA or at an angle greater than zero degrees and less than about 45 degrees with respect to the longitudinal axis LA. When referring to material flow direction, the term "forward" refers to movement generally in direction from the main frame infeed end toward the main frame discharge end and also includes movement in the vertical direction, such as, but not limited to, movement of material as it falls downward from one location to another by gravity or is elevated by a conveyor or the like. "Toward" is intended to include position or movement less than the distance to the edge of the structure or area referred to. As particulate material 12 is processed by the apparatus 10, material 12 moves generally forward from the infeed end 22 toward the discharge end 24 (though in exemplary embodiments material flow may be in a lateral direction, as discussed in greater detail hereinbelow).

Figure 2:
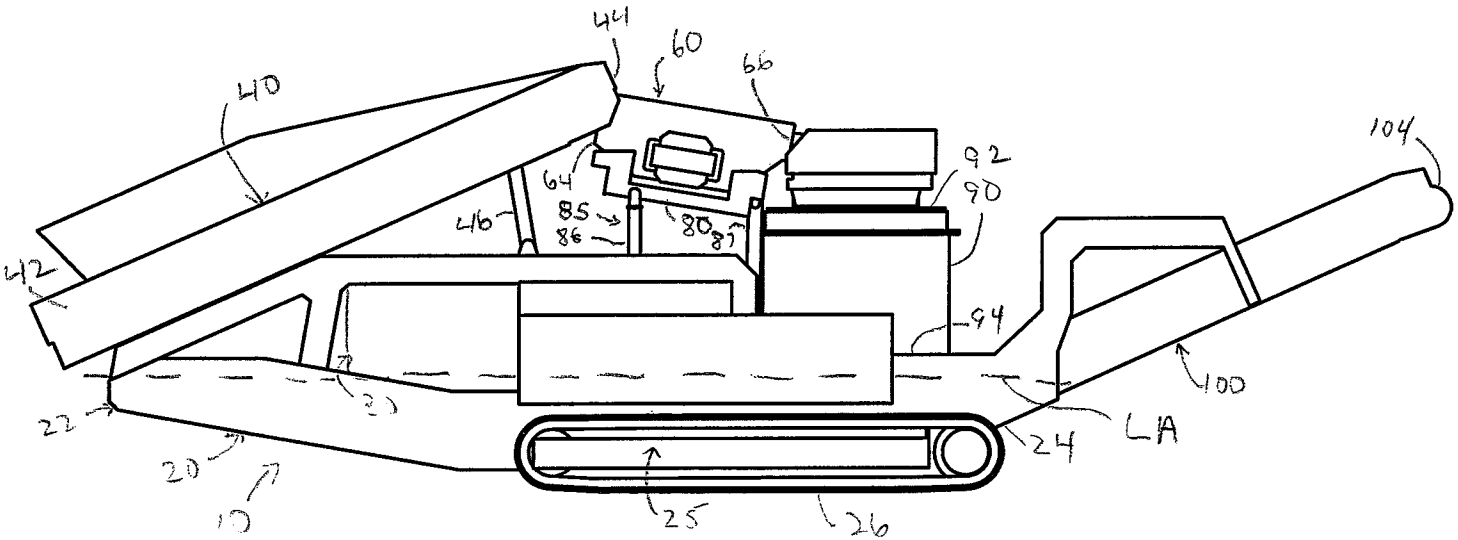
FIG. 2 is a side elevational view of a first exemplary embodiment of an apparatus of the present disclosure configured in an operating mode.
Figure 3:
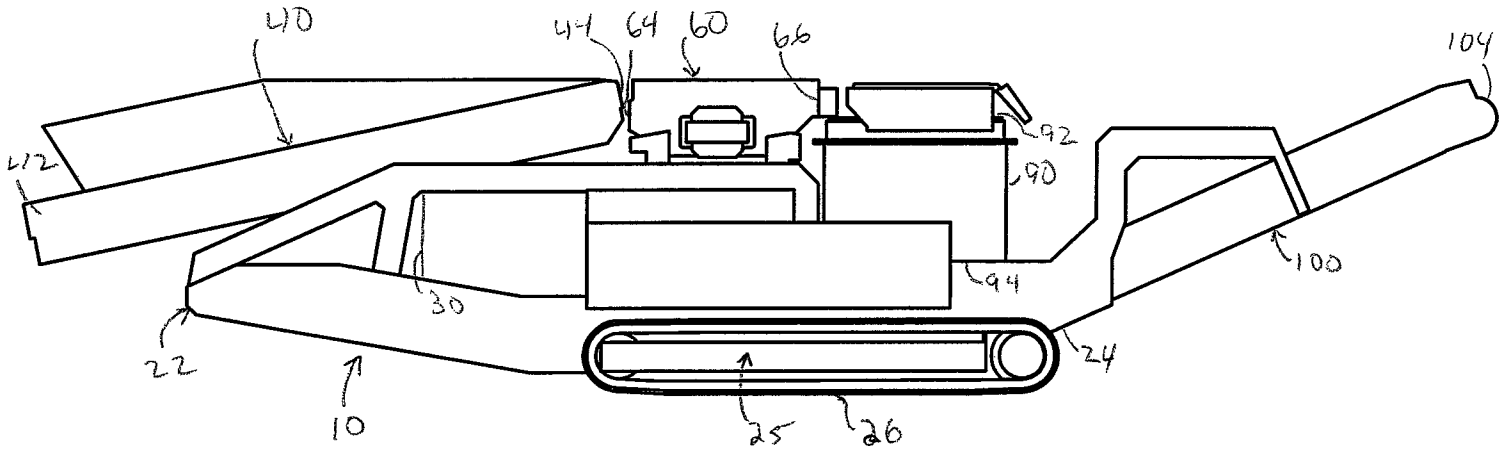
FIG. 3 is a side elevational view of the exemplary embodiment of the apparatus of FIG. 1 configured in a transport mode.

FIG. 2 shows apparatus 10 in an operating mode. Apparatus 10 can also be converted into a transport mode, shown in FIG. 3, as discussed in greater detail hereinbelow.

When in the operating mode, in exemplary embodiments, the apparatus 10 has various components positioned to move, separate, crush or otherwise act on the material, and when in the transport mode, the apparatus 10 is configured to be compact and ready to be transported.

In exemplary embodiments, the apparatus 10 includes an undercarriage assembly 25 that includes a mechanism for mobilizing the apparatus 10. In exemplary embodiments, the mobilizing mechanism may at least one, and, in exemplary embodiments, two sets, of endless tracks 26. Alternatively, the mobilizing mechanism may be one or more axles having wheels mounted thereon. Alternatively, the mobilizing mechanism may incorporate both wheels and at least one endless track. It is to be understood that other mobilizing means as are known to those skilled in the art can be used. The mobilizing mechanism may be passive, in other words, the apparatus 10 would be pulled or pushed by an external source, such as a tow cable or the like. Alternatively, the mobilizing mechanism may be active, in other words, the mobilizing mechanism can have a power source, such as an engine built into the undercarriage assembly, or the mobilizing mechanism can be operatively connected to an engine, as discussed hereinbelow, associated with the apparatus 10.

An engine 30 is associated with the main frame 20 and is positioned toward the infeed end 22. In exemplary embodiments more than one engine may be incorporated. The engine provides power to various components of the apparatus 10.

An infeed conveyor 40 has a receiving end 42 and a discharge end 44. The receiving end 42 is mounted proximate to the infeed end 22 of the main frame 20. The infeed conveyor discharge end 44 is associated with the main frame and, in exemplary embodiments, may be connected via at least one height-adjusting element 46 (such as, but not limited to, telescoping tube, pneumatic or hydraulic piston, linkage, arm, pivotable arm, elbow, other device or combinations of the foregoing, or the like, as discussed in greater detail hereinbelow) that can raise or lower the infeed conveyor discharge end 44 from a horizontal (or slightly angled) position to an angled (or more steeply angled) position. In exemplary embodiments, the infeed conveyor 40 is angled upward when the apparatus is in the operating mode and is moved into a more horizontal position when in the transport mode.

A screening assembly 60 comprises a frame 62 mounted to the main frame 20, a first end 64 and a second end 66 and at least one screen 70. In exemplary embodiments the screening assembly 60 includes an underscreen conveyor 80 mounted generally below at least a portion of the screen 70. In exemplary embodiments the screen 70 may include a vibration-inducing mechanism 72 associated with a motor (not shown) that can be actuated to cause the screen to vibrate or shake, such movement facilitating the separation and movement of smaller sized material down through the screen mesh 74. Material that is larger in diameter than the openings in the screen mesh 74 will move by gravity and/or vibration of the screen on toward the screening assembly second end 66.

In exemplary embodiments, the screening assembly 60 is mounted such that when the apparatus 10 is in the operating mode the screening assembly 60 is at an angle, such that the screening assembly first end 64 is elevated higher than the second end 66; i.e., the screening assembly 60 is angled downward toward the main frame discharge end 24. When the apparatus 10 is in the transport mode the screening assembly 60 is in either a generally horizontal position or a less angled position. In exemplary embodiments, the screening assembly first end 64 is positioned proximate to and either at the same height or below the infeed conveyor discharge end 44 so that the screening assembly 60 can receive material 12.

In exemplary embodiments, the screening assembly 60 may be moved between transport mode configuration and operating mode configuration by a positioning mechanism 85 which may comprise at least one height-adjusting element 86 that can be a telescoping tube, piston, linkage, arm, pivotable arm, elbow, other device or combinations of the foregoing that can raise or lower a portion of the screening assembly 60. If desired, the height-adjusting element may be mounted so as to pivot at one end. The height-adjusting element 86 may be chosen or configured to be manually manipulatable to increase height, or may be manipulated by being actuated by a power source. In one exemplary embodiment, shown in FIGS. 5A-D, the positioning mechanism 85 comprises a first telescoping element 86 and a second telescoping element 87, each of which is operatively associated with a power source and a control unit (not shown). The first telescoping element 86 includes a section 86A and a telescoping section 86B that are connected by a pivot pin 86C and a piston 86D such that the two sections 86A and 86B can pivot from an angled position, shown in FIG. 5A, to a straight position, shown in FIG. 5B that acts to elevate the first end 64 of the screening assembly 60. The second telescoping element 87 includes a telescoping section 87A that is connected to a connector section 87B by means of a pivot pin 87C. The connector section 87B is attached to the main frame 20. The second telescoping element 87 also has a piston 87D that causes the telescoping section 87A to increase or decrease its length. FIGS. 5C and 5D show the second telescoping element 87 pivot and increase in length so as to elevate the second end 66 of the screening assembly 60. The first telescoping tube 86 can raise the first end 64 to be higher than the second end 66, thereby inclining the screening assembly 60 at an angle. Designing the screening assembly 60 and positioning mechanism 85 to enable movement of the screening assembly from a transport mode to an operating mode enables the overall length of the apparatus 10 to be shortened because the screening assembly 60 does not have to be permanently mounted in position above and over the crusher (as described further herein).

In exemplary embodiments, an apparatus 10 includes at least one material crusher 90 associated the main frame 20. In one exemplary embodiment, the crusher 90 is a cone crusher, known to those skilled in the art. In exemplary embodiments, other types of crushing assemblies may be used, such as, but not limited to, jaw crushers or other compression crushers. The crusher 90 has an entrance end 92 and a discharge end 94. Material crushed by the crusher 90 exiting the discharge end 94 can be deposited onto a collection conveyor 100. In various exemplary embodiments, one or more additional collection conveyors may be utilized, as described in greater detail hereinbelow.

Figure 4:
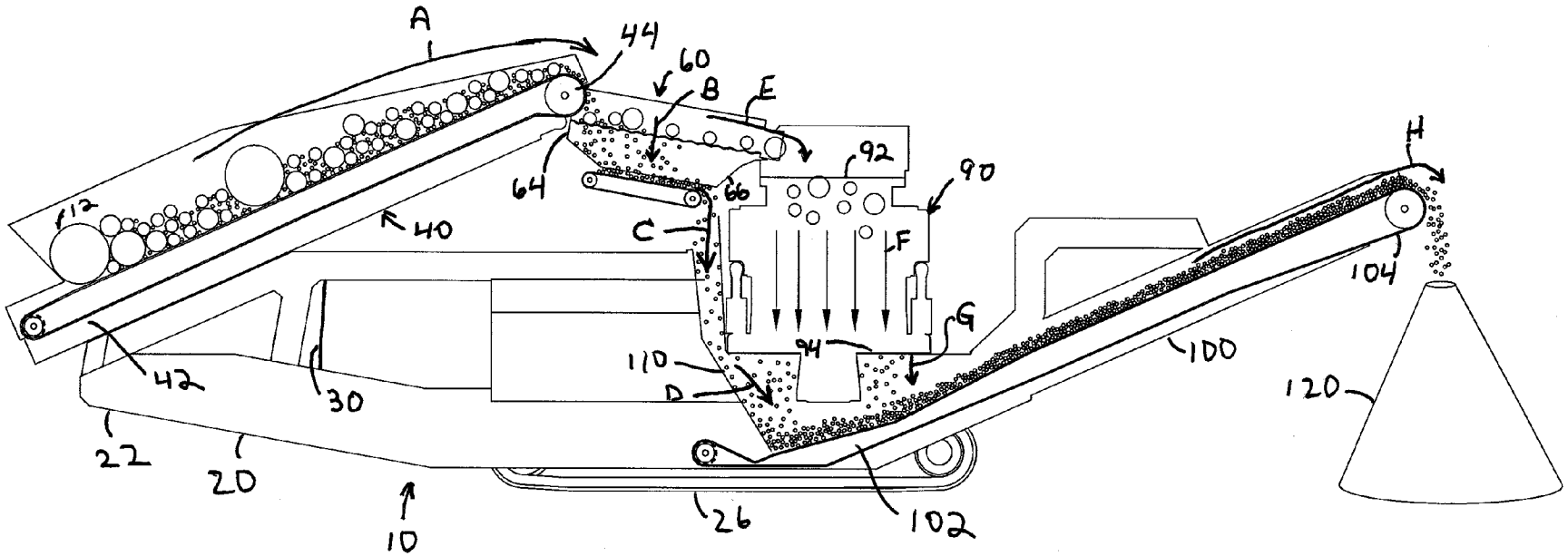
FIG. 4 is a side elevational view of the exemplary embodiment of the apparatus of FIG. 1 with arrows showing the material direction flow.

In one exemplary embodiment, shown in FIGS. 2 and 4, the apparatus 10 includes a first collection conveyor 100 having a receiving section 102 that refers generally to a portion of the collection conveyor 100 that receives material. The collection conveyor 100 also has a discharge section 104 that refers generally to a portion of the collection conveyor 100 where material exits the conveyor. In exemplary embodiments, the collection conveyor 100 is associated with the main frame 20 such that at least a portion of the receiving section 102 is positioned underneath at least a portion of the discharge opening 94 of the crusher 90 (as described in further detail hereinbelow).

Material that passes through the screen 70 onto the underscreen conveyor 80 exits via the screening conveyor second end 84 and falls onto the receiving section 102 of the collection conveyor 100.

Larger size material that does not pass through the screen 70 exits the screening assembly 60 off the underscreen 70. In one exemplary embodiment, shown in FIG. 4, this larger size material is delivered to a crusher 90. In exemplary embodiments, a deflector, such as, but not limited to, a chute, lip, flap, funnel or the like to direct material into the crusher 90 may be associated with the second end 66 of the screening assembly or may be associated with the opening 92 area of the crusher 90. The larger size material is reduced in size in the crusher 90 and is discharged from the discharge end 94 of the crusher 90, falling onto the deflector 110 and onto the collection conveyor receiving section 102. The collection conveyor 100 also conveys any smaller size material that has been discharged by the underscreen conveyor 80. In exemplary embodiments, a deflector 110 may be incorporated to guide the material.

In one exemplary embodiment, at least one deflector 110 may be incorporated to deflect or guide such material falling from the underscreen conveyor 80 onto the collection conveyor 100. The collection conveyor 100 conveys material away from the apparatus 10 to a discharge location, such as a discharge pile 120 on the ground, or the material may be conveyed or moved to another location or a transport vehicle, storage container, another conveyor or transport device, or the like.

In exemplary embodiments, an apparatus 10 in the transport mode is moved to the desired location. The apparatus 10 is converted into the operating mode by, among other activities, inclining the infeed conveyor 40, and positioning the screening assembly 60 so that material passing over the screen 70 will fall into the crusher 90. In exemplary embodiments, the collection conveyor 100 may be configured to move from a transport to an operating position. In other exemplary embodiments, the collection conveyor is fixed and does not move between modes.

The flow of material through the apparatus 10 is described as follows. The apparatus 10 may receive material that has been pre-sorted or pre-separated to remove large items, e.g., tree branches and roots, or the like, so that rocks, clumps of dirt, or the like remain.

Figure 5:
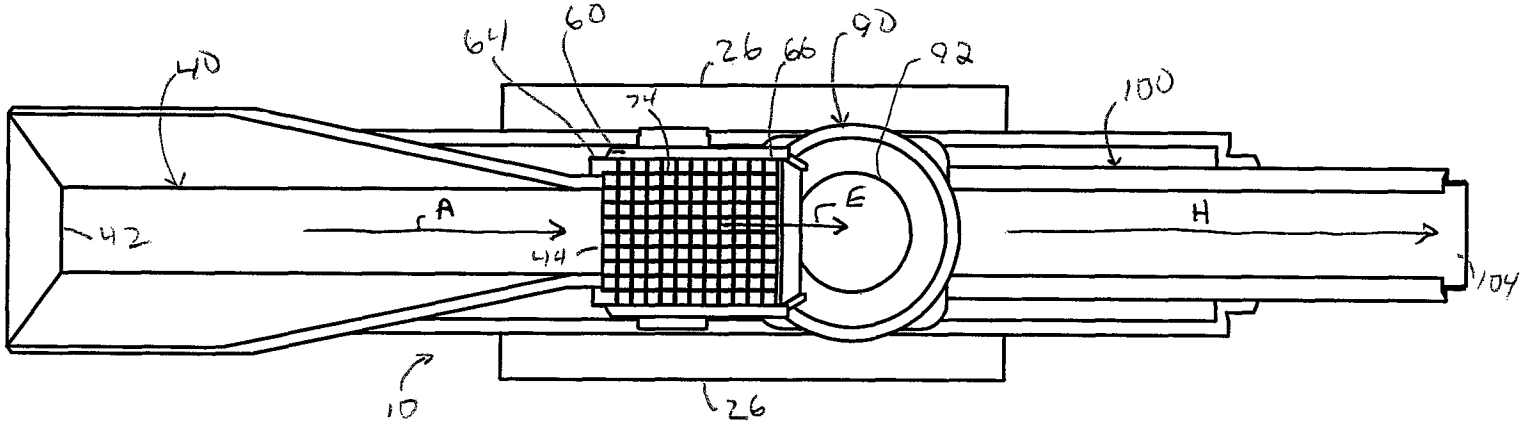
FIG. 5 is a top plan view of the exemplary embodiment of the apparatus of FIG. 1.
Figure 5A:
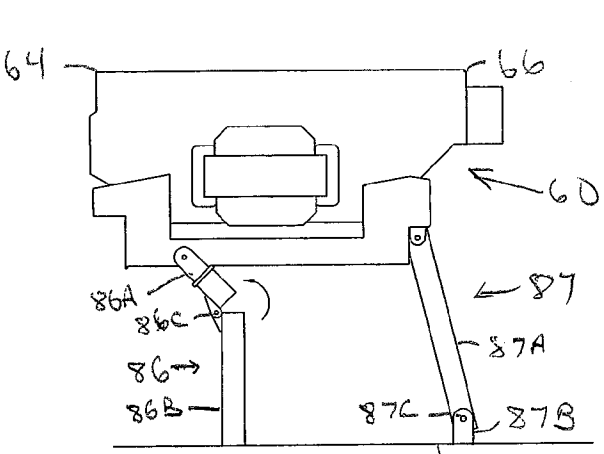
FIG. 5A is a side elevational view of a detail of the screening assembly showing the positioning mechanism according to one exemplary embodiment.
Figure 5B:
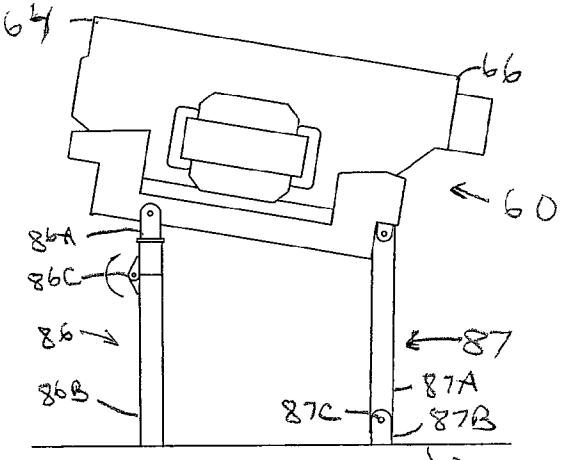
FIG. 5B is a side elevational view of a detail of the screening assembly showing the positioning mechanism according to one exemplary embodiment.
Figure 5C:
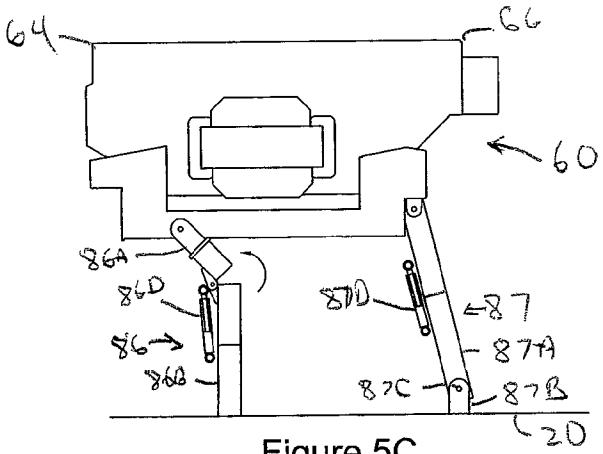
FIG. 5C is a side elevational view of a detail of the screening assembly showing the positioning mechanism according to one exemplary embodiment.
Figure 5D:
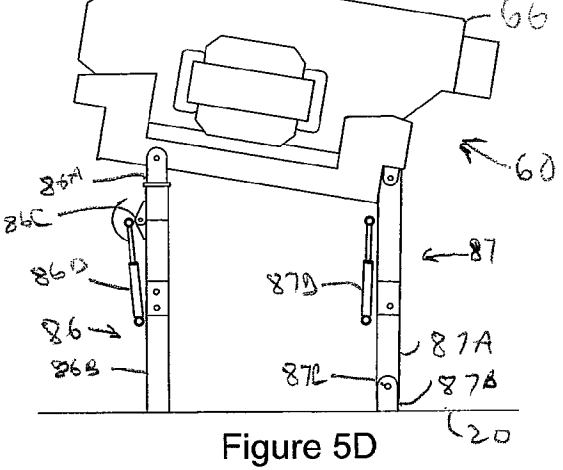
FIG. 5D is a side elevational view of a detail of the screening assembly showing the positioning mechanism according to one exemplary embodiment.

In the exemplary embodiment shown in FIG. 1-5, the infeed conveyor 40, screening assembly 60 (and underscreen conveyor 80), crusher 90 and collection conveyor 100, when in an operating mode, are arranged in-line, meaning that the material flow moves in a generally uni-directional manner, when viewed looking down from above the apparatus, as shown in FIG. 5. In other words, the material moves generally from the main frame infeed end 22 toward the main frame discharge end 24 without reversing direction back toward the main frame infeed end 22. In particular, in the exemplary embodiment shown in the side view in FIG. 4 with arrows indicating material flow direction, material is moved in a forward direction (with respect to the overall length of the main frame 20). In particular, the material is moved from the infeed conveyor 40 (material flow indicated as arrow "A"), to the screening assembly 60, where material passing down through the screen 70 and onto the underscreen conveyor 80 is moved in the direction of arrow "B". The flow of material falling downward toward the deflector 110 is shown by arrow "C. The flow of material from the deflector 110 onto the collection conveyor 100 is shown by arrow "D. The flow of material passing over the screen 70 is shown by arrow "E". The flow of material through the crusher 90 is shown by arrow "F". The crushed material is deposited onto the collection conveyor 100, the flow of which is shown by arrow "G". The flow of material from the collection conveyor 100 to a discharge pile 120 (representing one exemplary embodiment of a discharge location) is shown by arrow "H".

Figure 6:
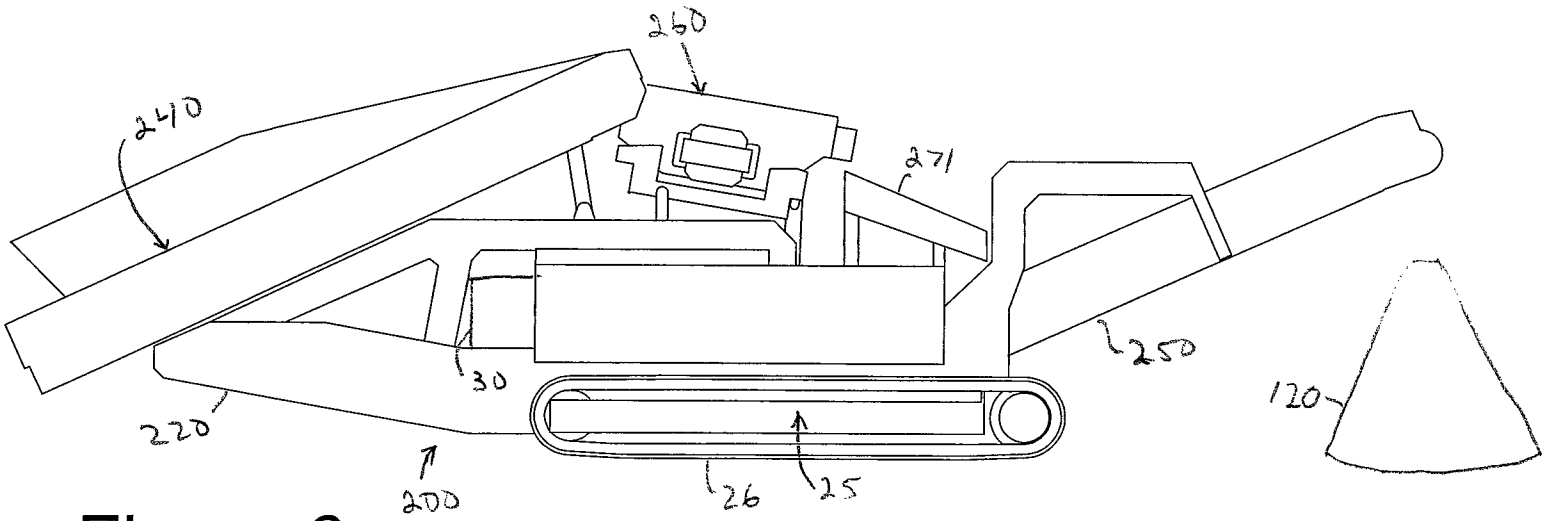
FIG. 6 is a side elevational view of an exemplary embodiment in which the apparatus does not include a crusher.
Figure 7:
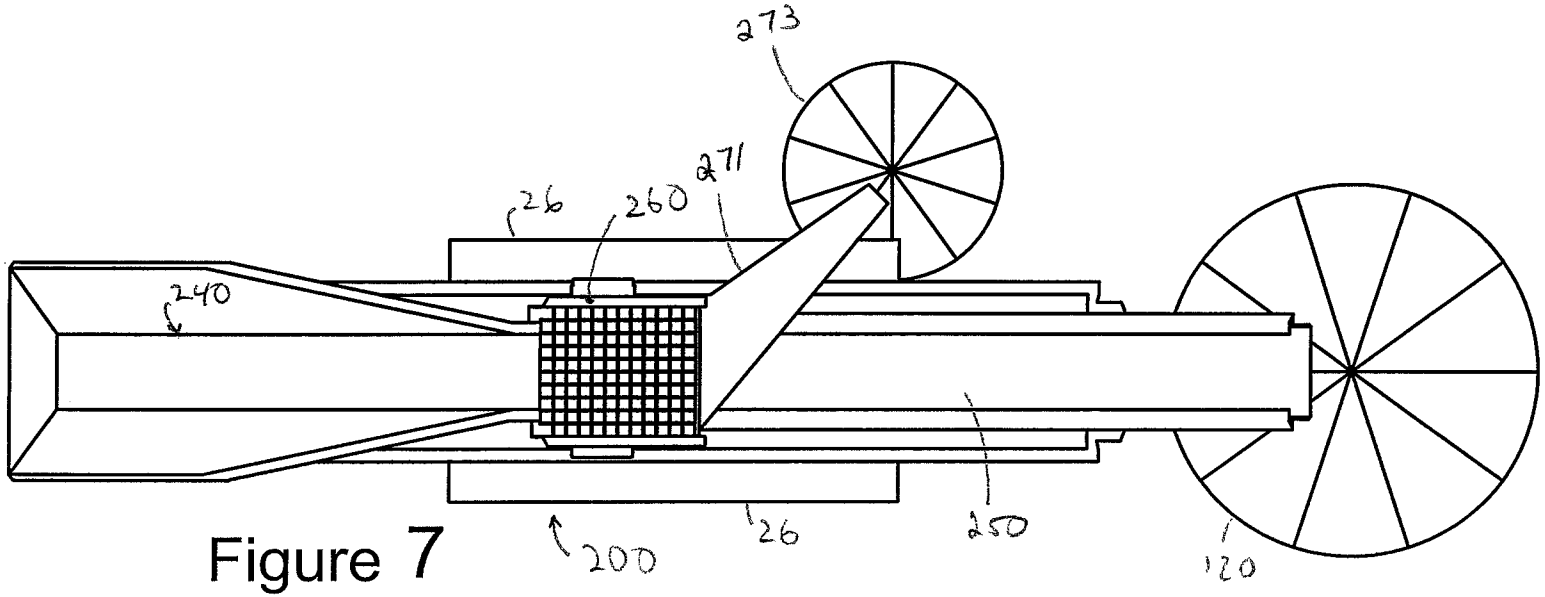
FIG. 7 is a top plan view of the exemplary embodiment of the apparatus of FIG. 6.

FIGS. 6-7 illustrates one exemplary embodiment of an apparatus 200, generally having the components described hereinabove of a main frame 220, an engine 230, an infeed conveyor 240, a screening assembly 260, a deflector 271 and a collection conveyor 250, but without a crusher. In this exemplary embodiment, material passing over a screen 270, commonly referred to as "overs," is deflected by a deflector 271 directly onto an overs discharge pile 273, without the heed for an overs discharge conveyor.

Figure 8:
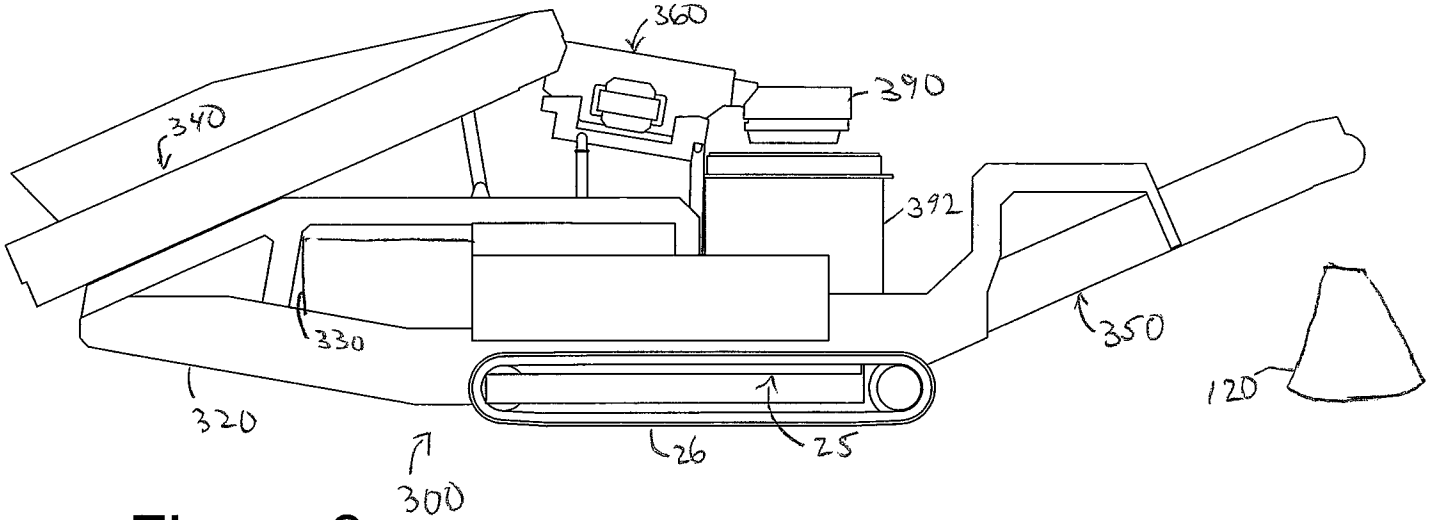
FIG. 8 is a side elevational view of an exemplary embodiment in which the apparatus includes two crushers.
Figure 9:
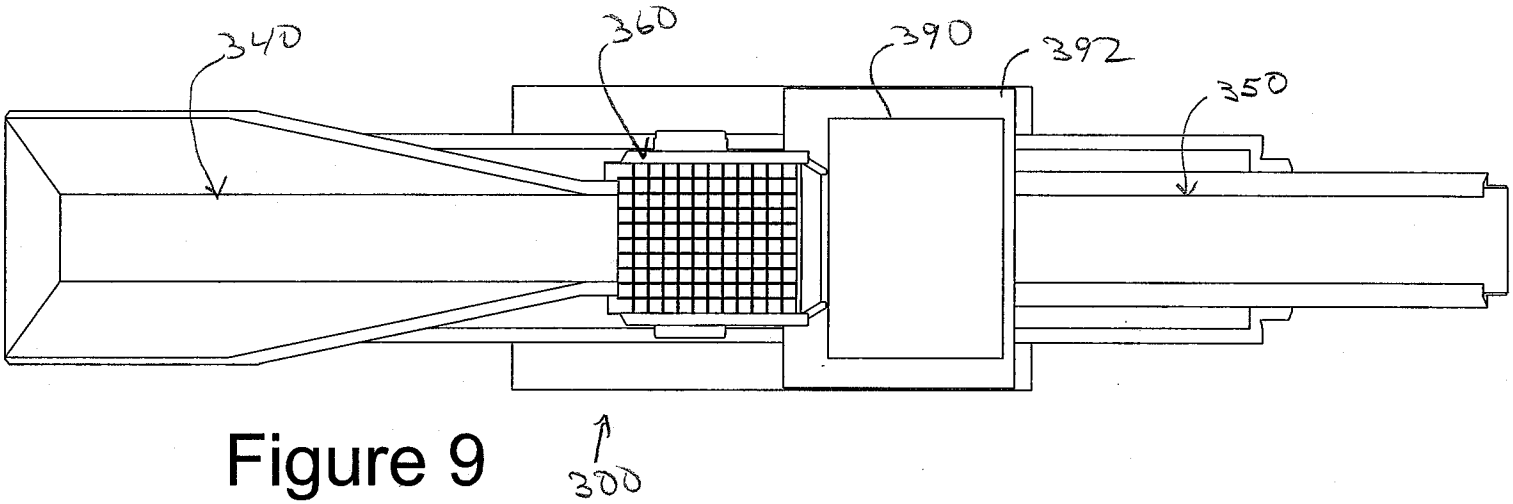
FIG. 9 is a top plan view of the exemplary embodiment of the apparatus of FIG. 8.

FIGS. 8-9 illustrates one exemplary embodiment of an apparatus 300, generally having the components described hereinabove of a main frame 320, an engine 330, an infeed conveyor 340, a screening assembly 360 having a screen 370, and a collection conveyor 350. Apparatus 300 further includes a first crusher 390 and a second crusher 392. The first crusher 390 may be, in exemplary embodiments, a compression crusher, such as, but not limited to, a cone crusher or a jaw crusher. In exemplary embodiments the second crusher 392 may have a jaw size smaller than the jaw size of the first crusher 392 so that the second crusher 392 can crush material down to an average size suitable for discharge onto a discharge pile 373. Material passing over a screen 370 is passed to a deflector 371, which directs material into the first crusher 390. The second crusher 392 receives material crushed by the first crusher 390. In exemplary embodiments the first crusher 390 is positioned at least partially above the second crusher 392 such that crushed material exiting the first crusher 390 drops into the second crusher 392. In operation, material is moved through the apparatus 300 in a uni-directional flow.

Figure 10:
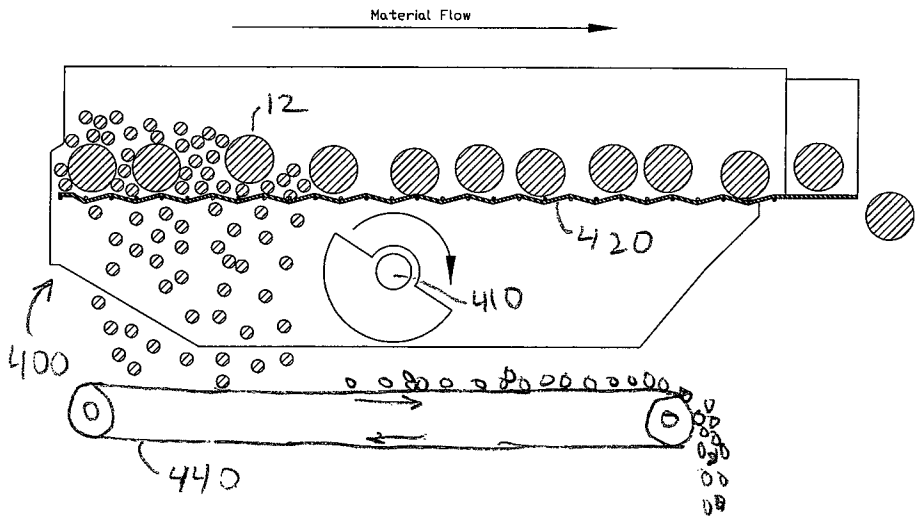
FIG. 10 is a side elevational view of an exemplary embodiment of a "horizontal" screening assembly.

In another exemplary embodiment, shown in FIG. 10, the apparatus 10 may incorporate, instead of the screening assembly 60 that moves material over the screen by vibration and gravity when inclined, a horizontal screening assembly 400. A horizontal screening assembly 400 moves material from one part of the assembly to another by vibration, rather than by gravity. Such a screening assembly 400 incorporates one or more shafts 410 associated with a screen 420 (or, more than one screen can be employed). The shafts 410 are operatively connected with a motor 430 (not shown). The motor induces the shafts 410 to rotate and, due to the shape of the shaft 410, cause the screen 420 to vibrate, thereby facilitating smaller size material to fall through the screen mesh and "walking" larger material across the screen 420 that does not pass through the screen. A horizontal screening assembly 400 does not, therefore, require an angled screen and gravity to move material across the screen. Material passing through the screen falls onto an underscreen conveyor 440. The horizontal screening assembly 400 can move from a first horizontal position in the transport mode in which the top of the screening assembly 400 is at or slightly below the level of the top of the crusher 90 to a second horizontal position in the operating mode in which a portion of the horizontal screening assembly 400 is over the top of the crusher 90 so that material passing over the screen 420 is conveyed to the crusher entrance end 92 opening. A horizontal screening assembly 400 can reduce the overall length of the apparatus.

Figure 11:
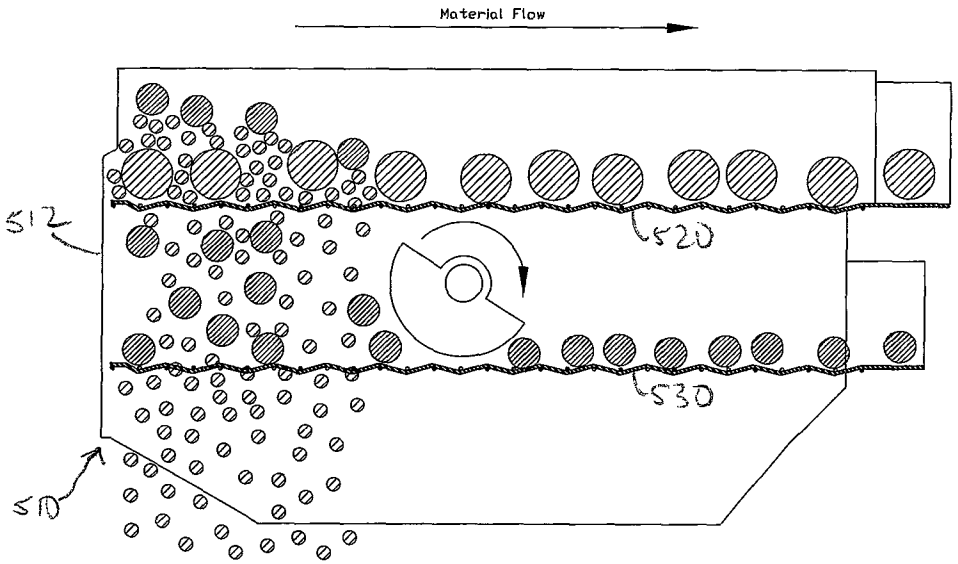
FIG. 11 is a side elevational view of an exemplary embodiment of a screening assembly having two screens.

In an alternative exemplary embodiment, an apparatus 500, similar to apparatus 10, may incorporate, instead of a single screen 70, a screening assembly 510 (shown in FIGS. 11-12) having a frame 512 which includes two or more screens 520, 530. Where two screens are used, the screens 520, 530 may be mounted generally parallel to one another in the frame 540, with an upper screen 520 (having a mesh size) being mounted over a lower screen 530 (having a smaller mesh size). Material falling through the upper screen 520 drops onto the lower screen 530, or, if the material is sufficiently small in size, it will fall through the lower screen 530.

Figure 12:
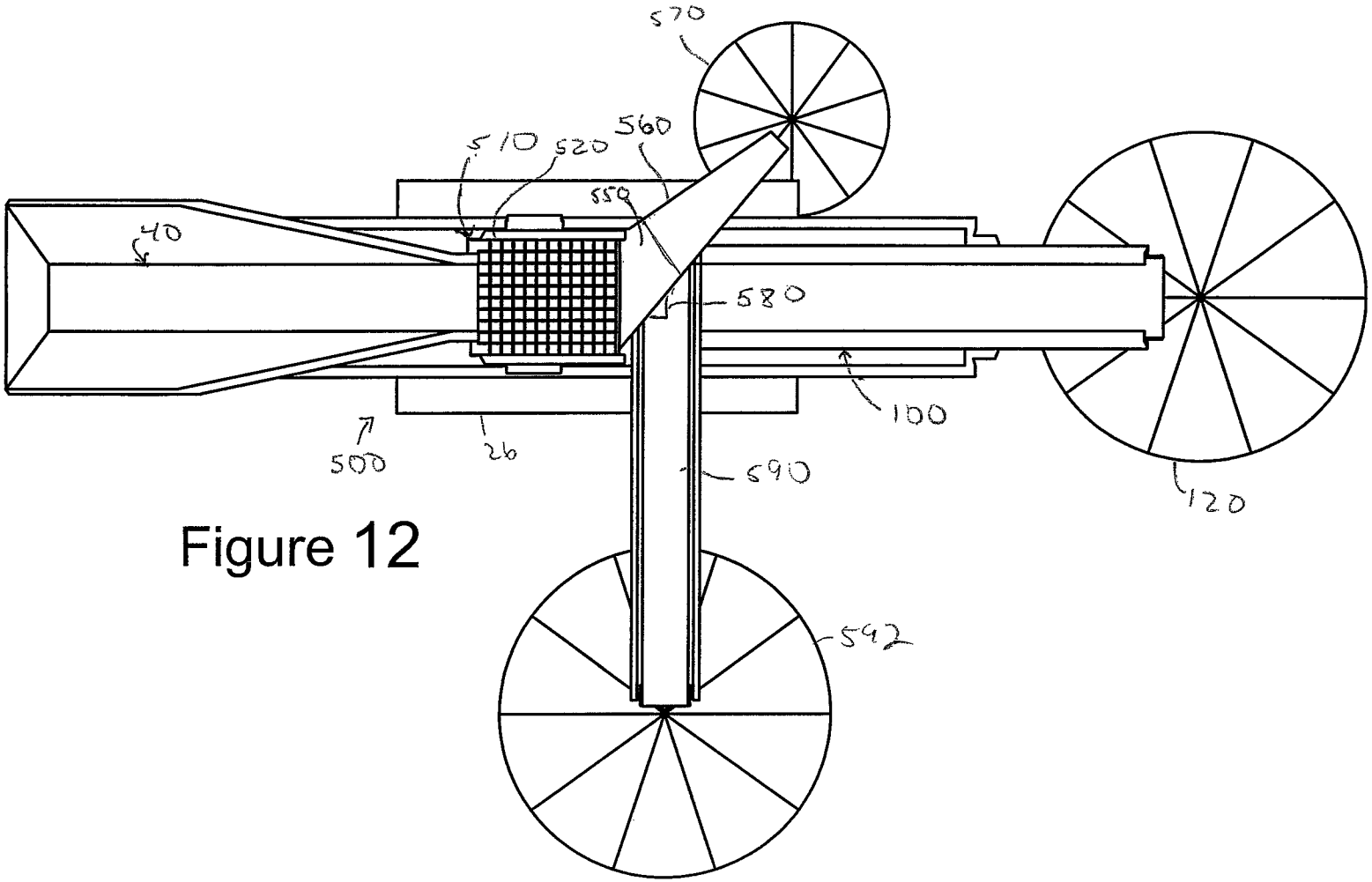
FIG. 12 is a top plan view of the exemplary embodiment of the apparatus of FIG. 11.

In one exemplary embodiment, shown in FIG. 12, material not passing through the upper screen 520 is conveyed to a deflector 550, which may direct material either to a separate conveyor 560 or directly onto a discharge pile 570. In another exemplary embodiment, where a crusher 90 is used, the material that does not pass through the upper screen 520, rather than being directed onto a conveyor 560 (no deflector 550 or conveyor 560 is required in this embodiment), is directed into the opening of the crusher 90, where it is crushed and processed as described herein with respect to apparatus 10.

Material remaining on the lower screen 530 is separated and moved to a deflector 580, which may direct material either to a separate conveyor 590 or directly onto a discharge pile 592. Material falling through the screen 530 is deposited onto a collection conveyor 100, similar as described further with respect to apparatus 10.

Figure 13:
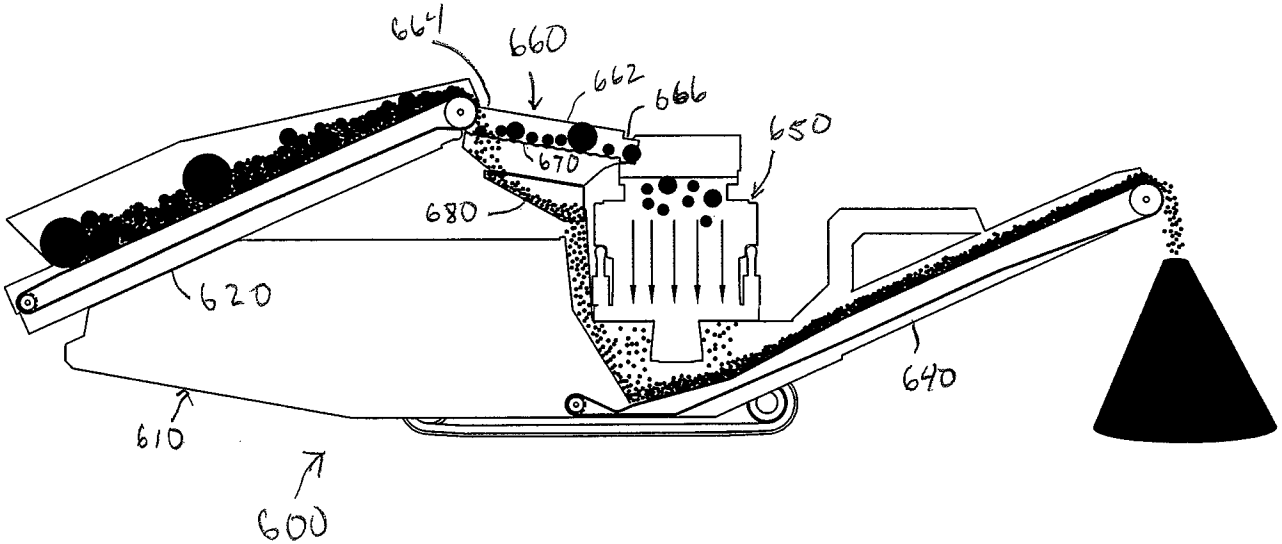
FIG. 13 is a side elevational view of an exemplary embodiment of an apparatus in which the screening assembly does not include an under screen conveyor.

In another exemplary embodiment, shown in FIG. 13, an apparatus 600 includes a main frame 610, infeed conveyor 620, collection conveyor 640 and a screening assembly 660. Optionally, the apparatus 600 may include a crusher 650. In this embodiment, the screening assembly 660 includes a frame 662 having a first end 664 and a second end 666. A screen 670 (or more than one screen) is associated with the frame 662. In this exemplary embodiment there is no underscreen conveyor, rather, there is a deflector 680 (which may be configured as a partial funnel, boxed frame, angled sheet, or other configuration) that deflects material passing through the screen 670 onto the collection conveyor 640. The deflector 680 may be mounted in a fixed position, or can be mounted so as to pivot or otherwise move from a transport mode configuration to an operating mode configuration. In exemplary embodiments, the deflector 680 may be associated with the screening assembly 660 and may vibrate with the screen 670.

Figure 14:
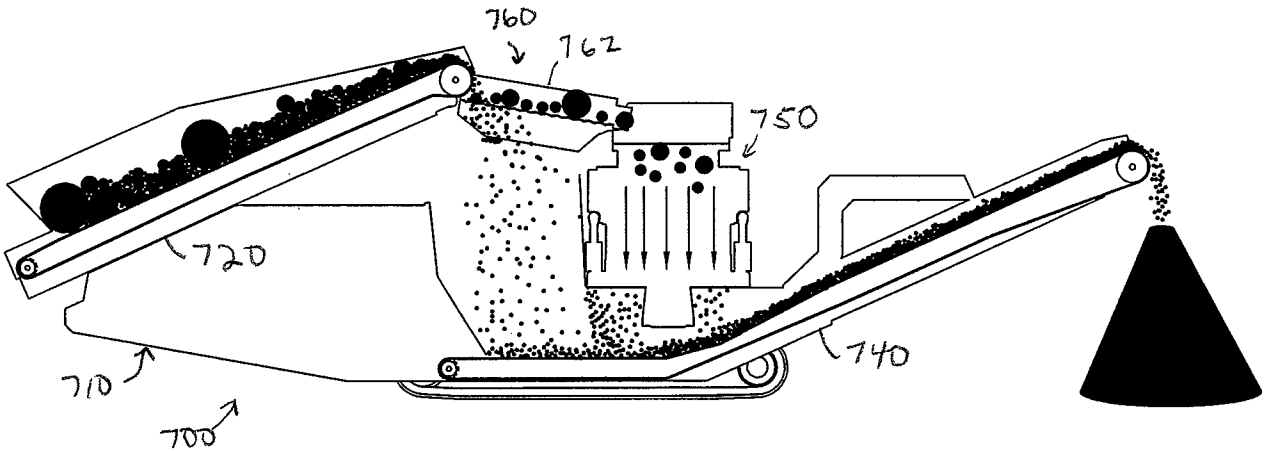
FIG. 14 is a side elevational view of an exemplary embodiment of an apparatus in which the screening assembly does not include an under screen conveyor and does not include a deflector.

In another exemplary embodiment, shown in FIG. 14, an apparatus 700 includes a main frame 710, infeed conveyor 720, collection conveyor 740 and a screening assembly 760. Optionally, the apparatus 700 may include a crusher 750. In this embodiment, the screening assembly 760 includes a frame 762 having a first end 764 and a second end 766. A screen 770 (or more than one screen) is associated with the frame 762. In this exemplary embodiment there is no underscreen conveyor, rather, rather, the collection conveyor extends to be at least partially underneath the screening assembly 760 so that material passing through the screen 770 falls directly onto the collection conveyor 740. Material exiting the crusher 750 also falls onto the collection conveyor 740.

The arrangement of components of a screening and sizing apparatus is important to the transport, operation, efficiency, flexibility, compactness and other characteristics of the apparatus. Certain arrangements, as described herein in various exemplary embodiments, can result in dramatically improved features; however, rearranging components is not an intuitive process as a substantial amount of engineering know how is utilized to develop an apparatus that has the desired features, but which can be transported and operated in the desired manner.

In conventional screening and sizing apparatus, for example, the apparatus disclosed in U.S. Published Application No. 2010/0193619 by Robinson, the screening assembly typically has the screen conveyor mounted over the screen. Material is conveyed by an infeed conveyor forward onto a screen conveyor, which in turn conveys material forward onto the screen. Material that falls through the screen drops via a chute onto a collection conveyor. Courser material that does not fall through the screen slides or rolls backward (i.e., in the reverse direction of the initial material flow onto the screen conveyor) down the screen and into a crusher. Crushed material falls onto the collection conveyor.

Conventional screening apparatus typically have the engine mounted in the area of the discharge end of the main frame and located over the collection conveyor. With such conventional engine placement the collection conveyor is typically curved upward so that material can have clear passage underneath the engine compartment. Such arrangements typically utilize a curved portion that is flatter (i.e., more horizontal) under the engine area, transitioning into a more steeply curved portion that is not under the engine. Such arrangements have the drawback that the collection conveyor is relatively long, resulting in an extended overall length of the apparatus. Additionally, curved conveyors can have more leakage and sealing problems compared to flat conveyors.

In the exemplary embodiments shown in FIGS. 1-5, the engine is generally located in the area of the infeed end of the main frame and under a portion of the infeed conveyor and the screening assembly. The arrangement of this exemplary embodiment provides a collection conveyor that is straight or essentially straight, rather than curved. Since the engine is not positioned over the collection conveyor, the collection conveyor does not have to follow a curved path around part of the engine in order to transport material. As a result length of the collection conveyor can be shorter, reducing the overall length of the screening apparatus. The use of a flat collection conveyor may also contribute to fewer leakage and sealing problems.

Placement of the engine below the infeed conveyor allows the engine to be directly coupled via drive belts to a crusher flywheel shaft, simplifying construction and reducing the engine horsepower needed to power the infeed conveyor. Additionally, as the engine is also below the screening assembly, the engine is better protected against falling debris.

Another result of the positioning and arrangement of the engine and collection conveyor is that an apparatus (in exemplary embodiments) incorporating a screening assembly can have a length not much longer than an apparatus without a screening assembly.

Adequate user access is needed from above to the screen, which occasionally requires unclogging, cleaning, replacement, or other servicing. Conventional screening apparatus incorporating screening assemblies that have the screen conveyor mounted over the screen, e.g., Robinson, as discussed hereinabove, reduce access to the screen from above. Such designs may require removal or repositioning of the screen conveyor to be out of the way so that the screen can be accessed from above.

In exemplary embodiments of the present screening apparatus the screening apparatus is designed with the conveyor being under the screen so that the screen itself is exposed from above, thereby providing easier access and eliminating the need to move a conveyor prior to obtaining access.

One aspect of the exemplary embodiment shown in FIGS. 1-5 is that the apparatus 100 does not require an overs conveyor since larger material passing over the screen is delivered to and crushed by the crushing apparatus, which delivers finer material onto the collection conveyor that also transports finer material that passes through the screen.

Design of material feed flow through the apparatus can affect the throughput speed as well as the susceptibility of the apparatus to clog. One existing apparatus design utilizes an infeed conveyor, screening assembly and a cone crusher, with the components arranged such that material flows from the infeed conveyor forward to the screening assembly, but material passing over the screen moves in a reverse direction (back toward the infeed conveyor) prior to falling onto the cone crusher.

A feature of the exemplary embodiments shown in FIGS. 1-5 is that the material flows in a forward direction (i.e., generally in the direction of the longitudinal axis) through the apparatus until it reaches the collection conveyor. This forward-only motion design improves the crushing rate and capacity. Also, such motion reduces clogging or material buildup due to directional change; e.g., in a conventional apparatus, long objects are less likely to get caught or thrown out at a turnaround point where direction reverses.

Screening apparatus of the general type as the presently disclosed apparatus may be considered transportable units and occasionally need to be transported from one location to another, for example, between job sites or from the manufacturer. Such apparatus typically have a travel mode configuration designed to reduce the dimensions of the apparatus and allow it to be moved, and an expanded operating mode configuration. Conventional transportable screening apparatus are typically moved by being placed on a carrier, such as, but not limited to, a flat truck bed. Such apparatus may be mounted on either endless tracks or wheels, with accompanying drive engine or linkage. In order for the apparatus to be transportable on a flatbed carrier, the overall height of the apparatus (including tracks or wheels) and the carrier on which it is loaded must have a height low enough to pass under bridges, through tunnels or other restricted-height areas. However, the apparatus operating mode typically in the apparatus having a height that is greater than that in the travel mode due to the configuration of the components when the apparatus is operating. The design, configuration and arrangement of the various apparatus components is important to the overall effectiveness of the apparatus in both travel and operating modes. Yet, there are a number of restrictions due to basic operating parameters that must be met, including, but not limited to, the placement of the engine so that it can be operatively linked with the various components the engine drives, the arrangement of the collection conveyor or conveyors so that discharged material is transported to a desired spot either laterally or forward of the main frame. Changing the location or orientation of one component can dramatically affect the relationship of the other components and movement of one component can result in other components becoming either less or totally ineffective. Therefore, redesign of screening apparatus to achieve desired operability as well as transportability involves substantial engineering innovation.

As shown in various exemplary embodiments of the present apparatus a configuration in which the engine is mounted under the screening assembly and the collection conveyor being oriented in-line with the main frame longitudinal axis results in several benefits. For example, the height of the apparatus in the transport mode is low enough that allows for flatbed carrier transport when in the transport mode to be under typical road height restriction limits. Additionally, such configuration allows for greater engine efficiency because the engine can be directly coupled via drive belts to the flywheel shaft of a cone crusher (in embodiments where present). Further, such configuration reduces collection conveyor length. Also, such configuration reduces the engine horsepower needed to power the conveyor, resulting in greater engine efficiency or reducing the size of the engine needed, as well as the fuel consumption.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

All patents, applications and publications referred to herein are incorporated by reference in their entirety.

What is claimed is:

1. An apparatus for sizing and separating particulate material, comprising;

a. main frame having an elongated rectangular structure and having a infeed end section and a discharge end section, the main frame having a longitudinal axis extending from the infeed end section to the discharge end section;

b. an engine associated with the main frame;

c. an infeed conveyor mounted to the main frame proximate to the main frame infeed end section, the infeed conveyor having an input end and an outflow end;

d. a collection conveyor associated with the main frame, the collection conveyor having an receiving section and a discharge section, the collection conveyor, when in an operating mode, being parallel to and in line with the longitudinal axis;

e. a screening assembly associated with the main frame and comprising i. a screening assembly frame having a first end and a second end, ii. a screen associated with the screening assembly frame configured to be positioned so that material passing over the screen feeds a crusher from above a feed entrance of the crusher, iii. a screening conveyor disposed substantially under the screen, the screening conveyor having a receiving end associated with the screening assembly frame first end and a discharge end associated with the screening assembly frame second end, the screening assembly first end being positioned proximate to and at least partially underneath the infeed conveyor discharge end, such that particulate material being discharged by the infeed conveyor discharge end is conveyed into the screening assembly proximate to the screening assembly first end, whereby smaller particulate matter passes through the screen, and whereby larger particulate material passes over the screen unit toward the screening assembly second end, iv. a positioning mechanism associated with the main frame and the screening assembly frame for moving the screening assembly from a transport mode first position to an operating mode second position, the mechanism comprising at least one height-adjusting element associated the screening assembly that can be operated to increase or decrease the height of at least a portion of the screening assembly with respect to the main frame, wherein material is discharged off the discharge end of the collection conveyor.

2. The apparatus of claim 1, further comprising a deflector having a first end positioned under the screening conveyor discharge end and a second end positioned above the collection conveyor receiving section, the deflector adapted to direct material from the screening conveyor to the collection conveyor.

3. The apparatus of claim 1, wherein the positioning mechanism is adapted to move the screening assembly from an essentially horizontal position to an inclined position.

4. The apparatus of claim 3, wherein the positioning mechanism comprises a first height-adjusting element including a first section and a telescoping second section comprising first and second telescoping segments, the first section and telescoping second section connected to each other by a pivot pin, and further including a first piston connected to the first section and the telescoping second section, the telescoping second section having one end associated with the main frame, and a second height-adjusting element including a telescoping member comprising a primary segment and a secondary segment, the telescoping member connected at one end by a pivot pin to a connector that is associated with the main frame, the telescoping member further including a second piston associated with the primary and secondary segments.

5. The apparatus of claim 1, wherein the screen unit comprises a first screen including a first screen deflector adapted to deflect material passing over the first screen to a first discharge location and wherein the screen unit further comprises a second screen, the second screen being disposed under the first screen, the second screen having a second screen deflector adapted to deflect material passing over the second screen to a second discharge location.

6. The apparatus of claim 1, further comprising at least one set of endless tracks associated with the main frame adapted to permit rolling movement of the apparatus.

7. An apparatus for sizing and separating particulate material, the apparatus having an operational configuration and a transport configuration, the apparatus comprising:

a. a main frame having an infeed end and a discharge end, the frame having a longitudinal axis extending from the infeed end toward the discharge end;

b. an engine associated with the main frame;

c. an infeed conveyor mounted to the main frame proximate to the front end, the infeed conveyor having an input end and an outflow end;

d. a first collection conveyor having an input end and a discharge end, at least a portion of the collection conveyor being disposed proximate to the discharge end and parallel to and in-line with the main frame longitudinal axis, whereby material that has been separated or sized is discharged from the apparatus;

e. a screening assembly associated with the main frame and comprising i. a screening assembly frame having a first end and a second end, ii. a screen associated with the screening assembly frame, iii. a screening conveyor disposed substantially under the screen, the screening conveyor having an first end associated with the screening assembly frame first end and a second end associated with the screening assembly frame second end, the screening conveyor first end being positioned proximate to and at least partially underneath the infeed conveyor outflow end, whereby particulate material being discharged by the infeed conveyor outflow end is conveyed into the screening assembly proximate to the screening assembly first end, whereby smaller particulate matter falls through the screen onto the screening conveyor and conveyed onto the first collection conveyor, and whereby larger particulate matter passes over the screen toward the screening assembly frame second end, iv. means for elevating/inclining at least a portion of the screening assembly from an essentially horizontal first position to a vertically elevated second position;

f. a crusher for crushing larger sized particulate material that does not pass through the screen, the crusher having a feed entrance opening disposed proximate to the screening assembly frame second end and the screen configured to be positioned so that material passing over the screen feeds the crusher from above the feed entrance opening of the crusher, the crusher further having a discharge outlet disposed above at least a portion of the collection conveyor; and, wherein the infeed conveyor, screening assembly and crusher are adapted such that during operation particulate material progresses in an in-line uni-directional manner generally along the longitudinal axis from the infeed conveyor receiving end to the screening assembly to the crushing unit, and, wherein the screening assembly is adapted to remove smaller particulate matter before passing into the crusher and direct such smaller particulate matter onto the collection conveyor and to allow predominantly larger particulate matter to pass into the crusher and subsequently direct crushed, now smaller, particulate matter onto the collection conveyor, thereby minimizing the potential of the crusher to clog due to excess smaller particulate matter.

8. The apparatus of claim 7, wherein the crusher is a cone crusher having a flywheel, whereby the engine is directly coupled to the cone crusher flywheel.

9. The apparatus of claim 7, where the crusher comprises a first crushing unit and a second crushing unit, the first crushing unit mounted to the frame and above the second crushing unit.

10. The apparatus of claim 9, wherein the apparatus further comprises a deflector associated with the first crushing unit for diverting material crushed by the first crushing unit away from the apparatus.

11. The apparatus of claim 7, wherein the engine is mounted below at least a portion of the infeed conveyor.

12. The apparatus of claim 7, wherein the screening assembly further includes a mechanism for vibrating the screen.

13. The apparatus of claim 7, further comprising a discharge conveyor positioned proximate to the discharge end of the screening conveyor, the discharge conveyor further positioned to convey particulate material away from the apparatus.

14. The apparatus of claim 7, wherein the screening assembly is adapted to move between a first position and a second position, the second position having at least a portion of the screening assembly being higher the entrance end of the crusher.

15. The apparatus of claim 7, further comprising an undercarriage assembly including means for mobilizing the apparatus.

16. The apparatus of claim 15, wherein the mobilizing means includes at least one set of endless tracks.

17. The apparatus of claim 15, wherein the mobilizing means includes at least one axle and set of wheels.

18. An apparatus for screening and sizing particulate material, comprising;

a. a main frame having an infeed end section and a discharge end section;

b. means for providing power to the apparatus;

c. means for separating smaller sized particulate material from larger sized particulate material such that smaller material passes through the means for separating while larger material passes over the means for separating;

d. means for crushing larger sized particulate matter received from the means for separating that does not pass through the means for separating, the means for crushing having a feed entrance disposed proximate to the means for separating and the means for separating configured to be positioned so that material passing over the means for separating feeds the means for crushing from above the feed entrance of the means for crushing;

e. first means for conveying particulate material to the means for separating;

f. second means for conveying material passing through the means for separating to a means for crushing larger sized particulate material;

g. third means for conveying smaller sized particulate material received from at least one of the means for separating and the means for crushing and conveying smaller sized particulate material to a discharge area, the third means for conveying being disposed at least partially below the means for crushing;

h. means for transporting the apparatus integrally connected with the apparatus; and, i. means for reciprocatingly inclining and declining the means for separating between an essentially horizontal transport mode position and an inclined operating mode position, whereby the first conveying means, the means for separating and the means for crushing are adapted such that particulate manner progresses through the apparatus in an in-line uni-directional manner (with respect to the direction from the apparatus front end to the apparatus discharge end) without reversing direction, and whereby the second means for conveying is disposed generally underneath the means for separating.

19. An apparatus for sizing and separating particulate material, comprising;

a. main frame having an elongated rectangular structure and having a infeed end section and a discharge end section, the main frame having a longitudinal axis extending from the infeed end section to the discharge end section;

b. an engine associated with the main frame;

c. an infeed conveyor mounted to the main frame proximate to the main frame infeed end section, the infeed conveyor having an input end and an outflow end;

d. a collection conveyor associated with the main frame, the collection conveyor having an receiving section and a discharge section, the collection conveyor, when in an operating mode, being parallel to and in line with the longitudinal axis;

e. a screening assembly associated with the main frame and comprising i. a screening assembly frame having a first end and a second end, ii. a screen associated with the screening assembly frame, the screen configured to be positioned so that material passing over the screen feeds a crusher from above a feed entrance of the crusher, iii. a screening conveyor disposed substantially under the screen, the screening conveyor having a receiving end associated with the screening assembly frame first end and a discharge end associated with the screening assembly frame second end, the screening assembly first end being positioned proximate to and at least partially underneath the infeed conveyor discharge end, such that particulate material being discharged by the infeed conveyor discharge end is conveyed into the screening assembly proximate to the screening assembly first end, whereby smaller particulate matter falls through the screen, and whereby larger particulate material passes over the screen toward the screening assembly second end, iv. a deflector disposed at least partially underneath the screening conveyor discharge end for deflecting material passing through the screen either to a discharge location or to a collection conveyor; and, v. a positioning mechanism associated with the main frame and the screening assembly frame for moving the screening assembly from a transport mode first position to an operating mode second position, the mechanism comprising at least one height adjusting element associated the screening assembly, wherein material is discharged off the discharge end of the collection conveyor.

20. An apparatus, comprising:

a. a frame;

b. a power source;

c. an infeed conveyor;

d. screening assembly having a top, a first end and a second end, a screen, and an underscreen conveyor;

e. positioning mechanism for raising, lowering and angling the screening assembly from a transport mode position to an operating mode position, the mechanism comprising a first height-adjusting element associated with the screening assembly first end, a second height-adjusting element associated with the screening assembly second end, the screening assembly having a transport mode position that is horizontal and the top being at or slightly below the level of a crusher feed entrance opening, the screening assembly being movable to an operating mode position by causing the first height-adjusting element to elevate at least a portion of the screening assembly, causing the screening assembly second end to be positioned above the crusher feed entrance opening; the screening assembly configured to feed material passing over the screening assembly to feed material from above the crusher feed entrance;

f. at least one deflector; and, g. a collection conveyor.

21. The apparatus of claim 20, wherein the mechanism is adapted to incline the screening assembly for use in the operating mode by raising the screening assembly first end so as to be higher than the screening assembly second end.

22. The apparatus of claim 20, further comprising a crushing apparatus for reducing the size of the particulate material.

23. An apparatus for sizing and separating particulate material, comprising;

a. main frame having an elongated generally rectangular structure and having a infeed end section and a discharge end section, the main frame having a longitudinal axis extending from the infeed end section to the discharge end section;

b. an engine associated with the main frame;

c. an infeed conveyor mounted to the main frame proximate to the main frame infeed end section, the infeed conveyor having an input end and an outflow end;

d. a collection conveyor associated with the main frame, the collection conveyor having an receiving section and a discharge section, the collection conveyor, when in an operating mode, being generally parallel to and in line with the longitudinal axis;

e. a screening assembly associated with the main frame and comprising i. a screening assembly frame having a first end and a second end, ii. a screen unit associated with the screening assembly frame, the screen unit configured to be positioned so that material over the screen unit feeds the crusher from above a feed entrance of the crusher, iii. a deflector disposed at least partially under the screen such that particulate material being discharged by the infeed conveyor discharge end is conveyed into the screening assembly proximate to the screening assembly first end, whereby smaller particulate matter passes through the screen, and onto the deflector which deflects the material onto the collection conveyor and whereby larger particulate material passes over the screen unit toward the screening assembly second end, iv. a positioning mechanism associated with the main frame and the screening assembly frame for moving the screening assembly from a transport mode first position to an operating mode second position, the mechanism comprising at least one height adjusting element associated the screening assembly that can be operated to increase or decrease the height of at least a portion of the screening assembly with respect to the main frame, wherein material is discharged off the discharge end of the collection conveyor.

24. The apparatus of claim 23, further comprising a crushing apparatus for reducing the size of the particulate material.

* * * * *